United States Patent [19]

Kwok et al.

[11] Patent Number: 4,927,081

[45] Date of Patent: May 22, 1990

[54] ROTARY ATOMIZER

[75] Inventors: Kui-Chiu Kwok, Arden Hills, Minn.; Bernard J. Marchand, Le Raincy, France

[73] Assignee: Graco Inc., Minneapolis, Minn.

[21] Appl. No.: 249,423

[22] Filed: Sep. 23, 1988

[51] Int. Cl.[5] ..... B05B 3/10

[52] U.S. Cl. ..... 239/223

[58] Field of Search ..... 239/223, 224, 700, 701, 239/702, 703

[56] References Cited

U.S. PATENT DOCUMENTS

| | | | |
|---|---|---|---|
| 364,947 | 6/1887 | Moore . | |
| 875,515 | 12/1907 | Frauenthal . | |
| 1,505,607 | 8/1924 | Schroeder . | |
| 1,526,748 | 2/1925 | Herman . | |
| 1,529,624 | 3/1925 | Johnson . | |
| 1,748,991 | 3/1930 | Pierce . | |
| 1,869,384 | 8/1932 | MacLachlan | 239/224 |
| 2,172,195 | 9/1939 | Elson | 253/2 |
| 2,396,005 | 3/1946 | Gross et al. | 85/1 |
| 2,417,494 | 3/1947 | Hoof | 251/160 |
| 2,728,606 | 12/1955 | Smart et al. | 299/63 |
| 2,857,184 | 10/1958 | Mancusi, Jr. | 286/26 |
| 2,922,584 | 1/1960 | Slatkin | 239/703 |
| 2,986,338 | 5/1961 | Foster | 239/222 |
| 3,178,114 | 4/1965 | Point | 239/15 |
| 3,193,251 | 7/1965 | Brunel et al. | 253/56 |
| 3,263,127 | 7/1966 | Point et al. | 317/3 |
| 3,417,963 | 12/1968 | Maverna | 253/2 |
| 3,504,851 | 4/1970 | Demeter | 239/15 |
| 3,540,653 | 11/1970 | Fabre | 239/15 |
| 3,630,441 | 12/1971 | Felici et al. | 239/15 |
| 3,746,348 | 7/1973 | Stone | 277/11 |
| 3,977,607 | 8/1976 | Kobayashi et al. | 239/145 |
| 4,232,991 | 11/1980 | Gamell | 415/90 |
| 4,290,091 | 9/1981 | Malcolm | 361/228 |
| 4,316,582 | 2/1982 | Kobayashi et al. | 239/692 |
| 4,405,086 | 9/1983 | Vetter | 239/224 |
| 4,429,833 | 2/1984 | Meisner et al. | 239/224 |
| 4,462,061 | 7/1984 | Mommsen | 361/227 |
| 4,605,168 | 8/1986 | Tachi et al. | 239/112 |
| 4,643,357 | 2/1987 | Culbertson et al. | 239/223 |
| 4,671,546 | 6/1987 | Arav | 285/368 |
| 4,760,965 | 8/1988 | Schneider | 239/224 |
| 4,776,520 | 11/1988 | Merritt . | |
| 4,838,487 | 6/1989 | Schneider | 239/224 |

OTHER PUBLICATIONS

Graco Pro Gun Series Power Supply; cited below.

"Pro Confidence", Copyright 1987 Graco Inc., Form No. 304–349 3/87, General information.

"Pro AA 4000 Manual Air Assisted Airless Electrostatic Spray Gun", Training Manual, Copyright 1985 Graco Inc., Form 300–141, pp. 13 & 14.

"Integrated Finishing Systems", Copyright 1985 Graco Inc., Form No. 300–107R 3/86, General Information, pages as marked.

"Cartridge–Powered Spray Guns for Robots and Reciprocators", Copyright Graco Inc. 1985, Form No. 304–257 10/85, General Information.

"Pro 4000 Manual Electrostatic Air Spray Gun", Copyright Graco Inc. 1984, Form No. 300–100, pp. 9 & 10.

*Primary Examiner*—Andres Kashnikow

*Assistant Examiner*—Michael J. Forman

[57] ABSTRACT

A rotary atomizer is provided with a center feed tube which forms a stationary central shaft. A rotating shaft is fitted over the stationary shaft with ball or air bearings and has a rotationally symmetric turbine wheel thereon. Located at the end of the rotating shaft is a rotary atomizing cup which is fed by the center feed tube. The forward face of the cup terminates in the discharge edge and is fed by a nearly continuous slot which is formed by a distributor located in the center of the cup and which is spaced from the main body of the cup by three small pins. A small portion of paint is allowed to flow through a diffuser located in the center of the distributor and which provides continuous wetting of the front of the distributor so as to prevent the flaking of dried paint.

3 Claims, 1 Drawing Sheet

ROTARY ATOMIZER

BACKGROUND OF THE INVENTION

Rotary atomizers including those with center feed designs are well known in the painting and coating arts. In particular, such devices have in the past tended to suffer from the problem of an area in the center of the cup or bell allowing dried paint to accumulate thereon which thereafter flakes off and lands on the work surface thereby harming the finish on the work surface.

Rotary atomizers have also tended to suffer from the problem of incomplete coating of the atomizing surface in the process of feeding paint from the feed chamber to the surface of the bell. In such devices, the paint is typically fed through a number of apertures but the materials between the apertures tends to cause streaks or dry areas on the bell surface during operation. Rotary atomizers also tended to be fairly bulky because of the precision bearings required and the high speeds at which they were run.

Such prior art devices have further suffered from the problem of wrapback, that is, paint tends to become deposited on the exterior surfaces of the turbine and drive housing.

SUMMARY OF THE INVENTION

It is therefore an object to provide a rotary atomizer which can eliminate dried paint build-up on its front rotating surface. It is further an object of this invention to provide a rotary atomizer which is light, compact and easily manufactured as well as easily serviced. It is further an object of this invention to provide a rotary atomizer which is highly resistant to paint build-up on its exterior surfaces.

A rotary atomizer cup is provided which has the main portion of the cup or bell with a large central bore in which is suspended a distributor assembly. A combination of the cup and distributor assembly forms therebehind a feed chamber which primarily feeds paint through an annular gap between the distributor assembly and the main cup to the front discharge surface of the cup.

The distributor assembly has located in the middle thereof a small diffuser which allows a very small proportion to the total paint fed through the center feed tube to pass to the middle of the front of the distributor. By precisely sizing the passages, a small cup-like area on the front of the distributor/diffuser assembly may be kept full of liquid paint, and that paint then flows off over the front surface of the distributor such that all of the front surface of any portion of the bell can be covered with wet paint. By suspending the distributor assembly on three small pins, total coverage of the front discharge surface of the cup with paint will be very uniform thereby providing superior atomization and finishing. This construction also makes for easy and quick flushing during color changing.

A combination center feed tube and stationary shaft extends forwardly from the housing base and is held in place by means of three set screws which engage a groove in the stationary shaft. A rotating shaft with a set of bearings is located over the stationary center shaft and has affixed to the front end thereof the rotary cup or bell atomizing element. Use of this construction allows the turbine assembly to be easily removed and serviced without the need to disconnect any hoses or the like thus minimizing downtime. The discharge end of the center feed tube extends into a feed chamber in the rear end of the cup.

The circumference of the cup extends forwardly and outwardly thereby providing a consistent outward flow of paint from the feed chamber to the forward surface of the bell which in turn leads to the discharge edge. A distributor assembly is suspended over the front end of the feed chamber by means of (preferably) three pins.

The distributor has located in the middle thereof a diffuser assembly which has a first axial bore which is tapering forwardly and which receives a small proportion of the total paint fed through the feed tube into the feed chamber. The tapered axial bore allows viscous paint to flow through with less restriction. The end of the tapered axial passage connects with a pair of radially extending cross bores which feed paint into a small depression in the front of the distributor. The sizing of these passages and the distributor is such that a small yet constant flow of paint is provided through the diffuser and into the depression and thence outwardly over the front face of the distributor thereby preventing dry spots. The mounting of the distributor with three pins provides a very even distribution of paint over the front surface of the cup and thereby prevents dead spots which do not become evenly covered with paint.

A turbine wheel having rotationally symmetric teeth not unlike gear teeth is provided and jets are located in the housing which may rotate the assembly in either direction and may also serve to act as a brake for quick stopping. The assembly may be easily and quickly disassembled and repaired by first removing the cup and then the rotating shaft and turbine blade assembly. This allows easy field servicing especially as the center feed tube may also be easily removed.

The housing may attach to a manifold through utilization of o-rings which sit in conical counterbores at the junction of passages between the manifold and the housing. This provision allows leakproof connections while at the same time accommodating some lack of precision in the location of such passage holes.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
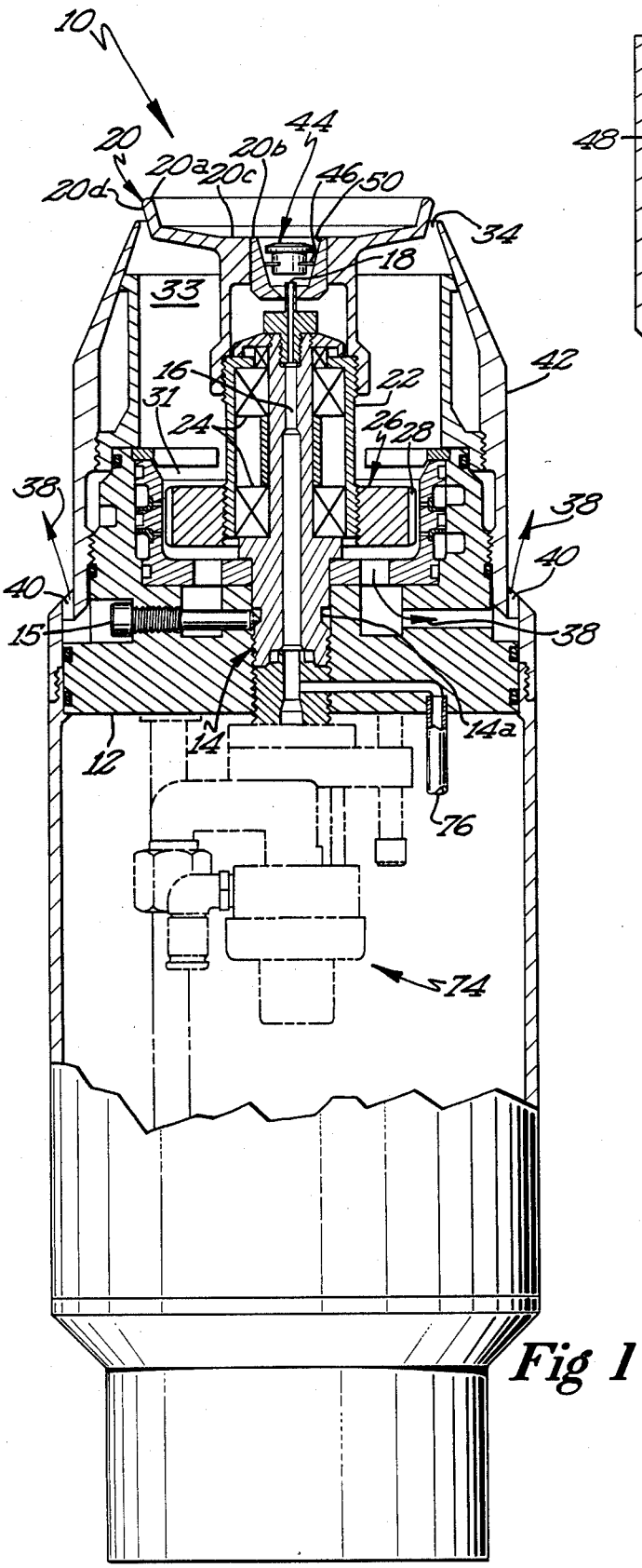
FIG. 1 is a cross-sectional view of the rotary atomizer assembly of the instant invention.

The rotary atomizer of the instant invention, generally designated 10 is shown in general in FIG. 1 and is comprised of a housing 12 having a center feed tube and shaft 14 located therein. Shaft 14 has a passage 16 for passing paint and the like and is provided with a discharge end 18 which extends into feed chamber 45. Shaft 14 is held in place in housing 12 by three set screws 15 which engage a groove **14*a* at the base of shaft 14. The rotary atomizing cup 20 is located on the forward end of rotating shaft 22 which rotates about fixed shaft 14 on bearings 24. For assembly, cleaning, changing and the like, fixed shaft 14, the rotary shaft 22 and bearings 24 may be removed merely by loosening the three set screws 15. Cup 20 threads onto the end of rotary shaft 22**.

Figure 3:
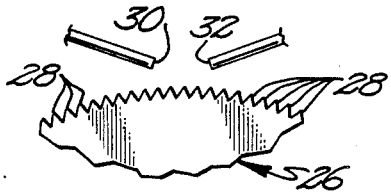
FIG. 3 is a cross-section of the turbine wheel.

Turbine wheel 26 is affixed to the outside of rotating shaft 22 and is provided with a plurality of teeth 28 which are shown in detail in FIG. 3. It can be seen that teeth 28 are rotationally symmetrical, that is, air blown in through either air passage 30 or 32 will serve to rotate the atomizer in opposite directions. Changing the passage through which the air is directed may serve to brake the spinning atomizer. This construction is also easily and inexpensively manufactured.

Air exits from the turbine blades 28 toward the front of the atomizer through chambers 30 and 32 and out the annular shaping air aperture 34 located adjacent cup 20. Another portion of the air exits through chambers 36 and thence through the passage designated by arrow 38 and out a plurality of apertures 40 located around the circumference of the shroud 42.

The exhaust from turbine 26 may be augmented by further pressurized air and it is an object of this invention to provide a sufficient volume of air to form a high volume, low velocity stream of air which will carry all of the paint emitted off the discharge edge **20*a* of cup 20 toward the work piece being painted. It is worth noting that apertures 40 are spaced backwardly from cup 20 a distance greater than the diameter of cup 20. While the use of shaping air from passages such as 34 as discussed above is well known in the art, such shaping air is ineffective in preventing wrapback. By spacing the jets rearwardly and by providing a relatively high volume of gentle, low velocity air, a much more efficient job is provided of carrying all of the paint or coating material to the work piece surface thus preventing wrapback or deposition of paint onto the shroud 42 of the rotary atomizer 10**. By utilizing turbine exhaust to help pattern flow, total air usage is minimized and very efficient operation results.

Figure 2:
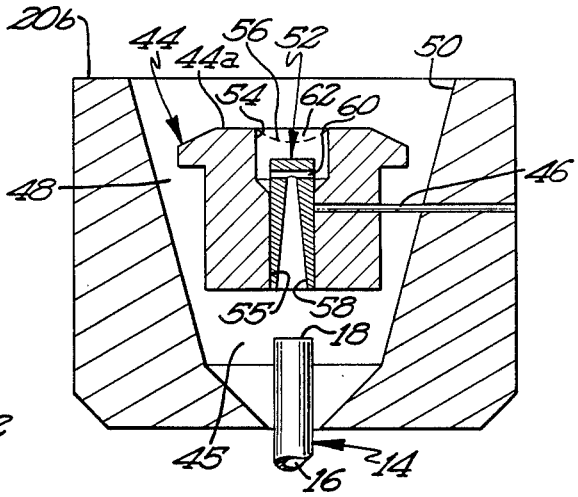
FIG. 2 is a detailed cross-section of the distributor/-diffuser assembly.

The construction of the center of the atomizing cup 20 is shown in more detail in FIG. 2. In particular, a center portion 20b is typically machined of a plastic material and is press fitted into the main portion of rotary atomizing cup 20 as shown in FIG. 1. The main portion of cup 20 is typically machined of a metallic material.

A distributor member 44 is located in the middle of center piece **20*b* and suspended there by three pins 46. The passage 48 between distributor 44 and centerpiece 20*b* is substantial enough that a very large proportion (greater than 90%) of the paint which flows out of center feed tube 18 and into feed chamber 45 runs through annular passage 48. Because of the minimal obstruction to 360 degree passage of paint through passage 48, pins 46** present a minimal obstruction and in fact the paint closes back together after passing around those pins.

Note that the inner surface 50 of centerpiece **20*b* is tapered upwardly and outwardly toward the forward end of the cup such that the centrifugal force generated by the spinning of cup 20 causes the paint to run upwardly and outwardly to the front face 20*c* of atomizing cup 20 whereupon it runs outwardly to discharge edge 20*a***.

A diffuser member 52 is press fit into the center of distributor 44. Distributor 44 is provided with an enlarged upper bore 54 which forms a depression 56 therein. Diffuser 52 is provided with a lower tapered bore 58 which tapers upwardly and inwardly in along the axis of distributor 52 whereupon it terminates in cross drilled radial passages 60 which lead into chamber 56. It can be noted that by careful sizing of passages 58 and 60, the desired proportion of paint coming out of center feed tube 18 and into feed chamber 45 will pass into chamber 56 and substantially fill that chamber forming a meniscus as shown by the dotted line 62. As paint runs out of chamber 56, it will flow over the top surface **44*a* of distributor 44 and thence outwardly over the front surface 20*c* of rotary atomizer 20**. By utilizing this construction, all parts which are at all weathered by paint on the front of the atomizing assembly are continually wetted such that no paint is allowed to dry and thence flake off.

The two cross drilled holes 60 resulting in four outlets into chamber 56 are, in the preferred embodiment, of a diameter of 0.84 mm. With a typical paint, this dimension is sufficient to pass enough paint to keep the front surfaces wetted and provide the meniscus 62 shown therein.

Figure 4:
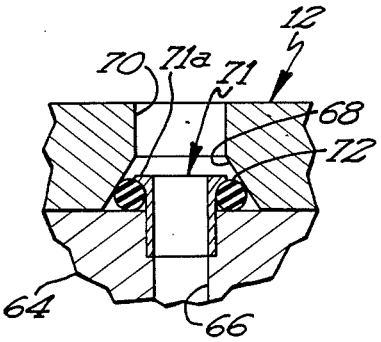
FIG. 4 shows detail of the O-ring connection used to connect the housing to the manifold.

As shown particularly in FIG. 4, housing 12 is attached to manifold 64. This junction is not shown in FIG. 1 but would be located off the bottom of FIG. 1 where mounting would take place. A number of passages 66 (only one is shown for sake of clarity) are located in manifold 64 and are provided with a conically drilled counterbore 68 at the surface thereof. An O-ring 72 is located in counterbore 68 and is retained there by means of retainer 71. Retainer 71 is press-fit into manifold 64 and is provided with a retaining lip 71a which engages O-ring 72. Housing 12 has a plurality of passages 70 extending there through. Utilization of the conical counterbore 68 in combination with retainer 71 and O-ring 72 allows an efficient sealing device and which serves to locate O-ring 72 quickly and easily during assembly without allowing O-ring 71 to fall out of place. This construction is also quite efficient in accommodating slight inaccuracies in manufacturing concerning the location of passages 66 and 70 relative to one another.

FIG. 1 also shows a trigger valve 74 at the inlet to passage 16. Trigger valve 74 is a conventional construction color valve and may be triggered as desired. A supplementary flushing passage 76 joins passage 16 just downstream of trigger valve 74. The supplementary flushing passage 76 allows air and/or solvent to be directed through the rotary atomizer for flushing at the same time as the line leading to the trigger valve 74. This construction allows for quick and efficient color changing in a production line environment. A check valve can also be installed in passage 76 before passage 76 joins passage 76. This prevents paint from being pushed back to the upstream of passage 76.

It is contemplated that various changes and modifications may be made to the rotary atomizer without departing from the spirit and scope of the invention as defined by the following claims.

What is claimed is:

1. A rotary atomizer for applying coating materials in combination with a turbine and a stationary center feed tube connected to a source of coating materials and having a discharge end, said rotary atomizer comprising:

a cup having a forward facing surface with a discharge edge and a central bore having a diameter;

a distributor adjacent said feed tube end and having an outside diameter substantially smaller than said central bore, said distributor further having an axial bore;

a diffuser pressed into said axial bore and comprising: forward and rear ends;

an axial passage located coaxially with said feed tube for receiving material from said feed tube end and extending forwardly from said rear end of said diffuser, said rear end being adjacent said feed tube said axial passage tapering inwardly from said rear end to said front end; and at least one radial passage extending radially outwardly from said axial passage and communicating with said axial bore said forward end of said diffuser being spaced rearwardly from the forward end of said distributor forming a depression in said forward end of said distributor; and pins coaxially locating said distributor in said central bore of said cup and in annularly spaced relationship thereto, said distributor being connected to and supported by said cup only by said pins, said radial and axial passages and said depression being sized to substantially fill said depression with liquid coating materials when in operation and whereby a substantial majority of the paint exiting said center feed tube discharge end passes on to the forward facing surface of said cup through the annular space formed between said distributor and said cup, and said paint discharging from said distributor recess flowing substantially radially outwardly to said cup forward surface.

2. The rotary atomizer of claim 1 wherein said distributor is located by three of said pins.

3. The rotary atomizer of claim 1 wherein said pins are located radially.

* * * * *